United States Patent [19]

Engel

[11] 4,438,579

[45] Mar. 27, 1984

[54] THREE-DIMENSIONAL PICTURE WITH INTERCHANGEABLE SCENES

[76] Inventor: Robert W. Engel, 2745 Provincetowne Dr., Toledo, Ohio 43613

[21] Appl. No.: 490,521

[22] Filed: May 2, 1983

[51] Int. Cl.[3] ..... G09F 1/12

[52] U.S. Cl. ..... 40/160; 40/10 D; 63/22; 428/13

[58] Field of Search ..... 428/13; 40/10 D, 10 R, 40/152, 160, 358; 63/22, 23

[56] References Cited

U.S. PATENT DOCUMENTS

| | | | |
|---|---|---|---|
| 2,190,273 | 2/1940 | Shapiro | 40/152 |
| 2,220,038 | 10/1940 | Kreisler | 40/152 |
| 2,731,812 | 1/1956 | Sullivan | 63/23 |
| 2,778,208 | 1/1957 | Flint | 63/23 |
| 3,670,525 | 1/1972 | Mulligan | 63/23 |
| 3,829,998 | 8/1974 | Flax | 40/160 |
| 3,868,283 | 2/1975 | Scheyer | 40/160 |

FOREIGN PATENT DOCUMENTS

| | | | |
|---|---|---|---|
| 170972 | 2/1951 | Austria | 40/160 |

*Primary Examiner*—Gene Mancene
*Assistant Examiner*—Wenceslao J. Contreras
*Attorney, Agent, or Firm*—Richard L. Hansen

[57] ABSTRACT

A kit for making a three-dimensional picture includes a frame encircling a three-dimensional window into which may be inserted a plurality of substantially planar decorated scenes. The depth of a scene in the window in determined by bending backward resilient hinges carried at the edges of the scene. The scenes are removably anchored in the window by frictional engagement between the hinges and the inner sides of the frame. Cut out regions in the scenes permit more remote scenes to be viewed, creating a three-dimensional effect. Including replicas of scenes allows more than one picture to be created with the kit.

13 Claims, 14 Drawing Figures

THREE-DIMENSIONAL PICTURE WITH INTERCHANGEABLE SCENES

This invention is in the field of three-dimensional displays, pictures and ornaments; more particularly, kits or assemblages for creating such articles, as well as the articles themselves.

Collections of craft materials are available in commerce to enable persons with artistic inclinations to create works of art as a pastime or hobby. Some such works are three-dimensional, e.g., those disclosed in U.S. Pat. Nos. 3,614,840 and 3,752,730. Once assembled according to the enclosed instructions, craft kits are usually finished, i.e., the nature of the display is fixed. Some artistic works are designed to permit the display or picture to be changed after completion; U.S. Pat. No. 4,177,305 exemplifies such an artistic creation, but such displays in kit form are rarely found.

Accordingly, it is one object of this invention to provide a craft kit for creating a three-dimensional framed picture or ornament. It is another objective to provide a kit in which portions of the display are removable and spares are provided, permitting interchangeable creation of more than one picture from the kit. It is yet another objective to provide such kit in an uncomplicated, inexpensive format, readily understood and assembled by persons of all ages. Finally, it is an objective of this invention to provide an esthetically pleasing work of art.

These objectives are attained by means of a kit which includes a frame encircling a three-dimensional window into which may be removably inserted a stack of substantially flat decorated scenes, spare scenes being provided. The depth of a scene in the window is set by bending backward resilient hinges carried at edges of the scene. The scenes are removably anchored in the window by frictional engagement between the hinges and the inner sides of the frame. Cutting out regions in the nearer scenes, permitting more remote scenes to be viewed, creates a three-dimensional effect. Materials may be provided in the kit for coloring, decorating, or otherwise adorning the frame or the plurality of scenes.

Various advantages and novel features which characterize this invention are particularly pointed out in the appended claims. However, for a better understanding of the invention, its advantages, and the objectives to be attained by its use, reference should be made to the drawings, in which preferred embodiments containing optional features are illustrated, and in which the elements are identified by the same numbers throughout, as well as the following description.

Figure 1:
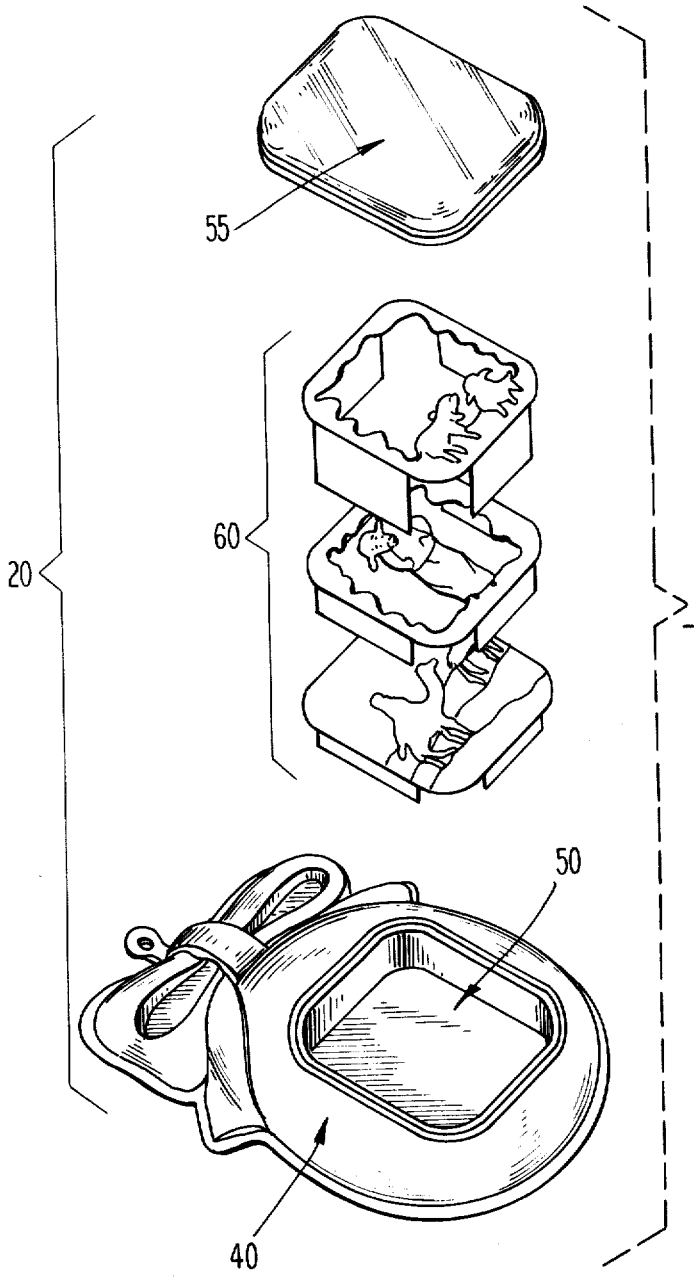
FIG. 1 is an exploded perspective view of one embodiment of the three-dimensional picture of this invention, a Christmas ornament.
Figure 3:
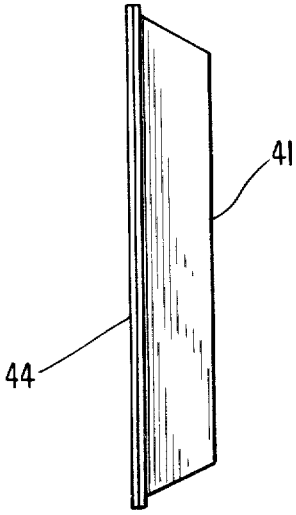
FIG. 3 is a side view of the frame shown in FIG. 2.
Figure 2:
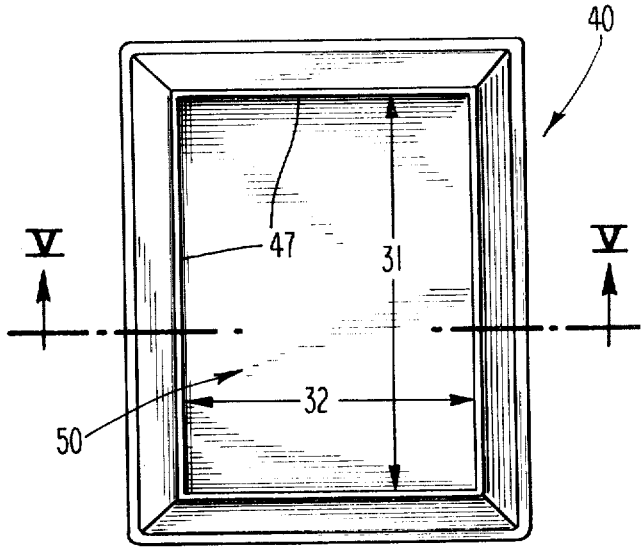
FIG. 2 is a front plan view of the frame employed in a kit embodied within this invention.
Figure 4:
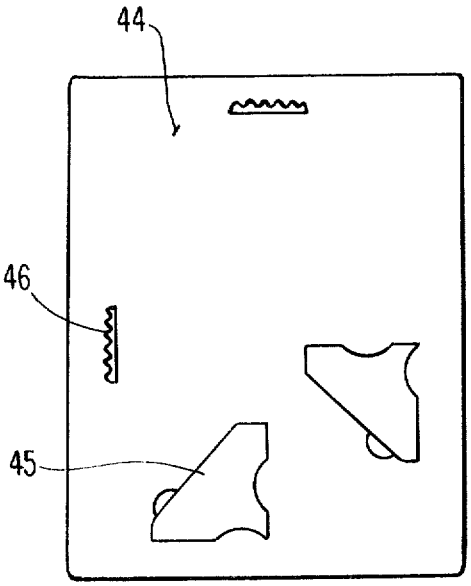
FIG. 4 is a view of the back of the frame shown in FIG. 2.

Attention is first directed to FIG. 1 for an overview of this invention. FIG. 1 illustrates a three-dimensional picture ornament. Picture 20 includes frame 40 having window 50 into which are removably fitted a plurality of scenes 60. Frame 40 is adapted to accept optional transparent dust cover 55 after the scenes have been inserted into the window.

FIGS. 2–5 are directed to the frame, one component of the kit of this invention. The outside shape, dimensions, and decoration of frame 40 are matters of aesthetic taste, rather than function, and the frame may be constructed of heavy paper or cardboard, rigid or soft plastic foam, or extrusion molded plastic, for example. Frame 40 has inner sides 47, which encircle and circumscribe window 50. The spaced inner sides establish the length 31 and the breadth 32 of a display.

Figure 5:
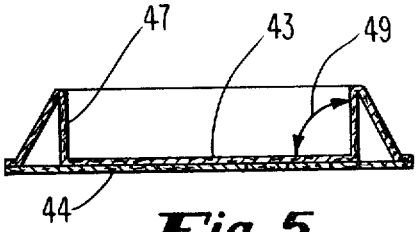
FIG. 5 is a cross-sectional view of the frame shown in FIG. 2 taken along V—V.
Figure 5A:
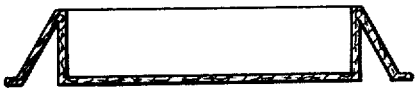
FIGS. 5A, 5B and 5C are cross-sectional views like FIG. 5, but illustrate alternative constructions.
Figure 5B:
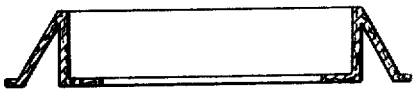
Figure 5C:
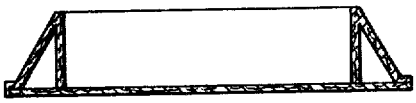

The inner sides make an interior angle 49 with backplate 43. Angle 49 will often be substantially a right angle, and an angle of at least 90 degrees, e.g., 90–95 degrees, may be desirable. For example, frame 40 and backplate 43 may be molded as a unitary structure, and an angle slightly greater than 90 degrees will permit trouble-free mold release. Such unitary construction is illustrated in FIGS. 2–5, as well as FIGS. 5A and 5B. FIG. 5C illustrates a structure in which frame 40 and backplate 43 are produced separately and later joined, e.g., with cement. It may also be advantageous to affix a reinforcement member 44, which may be made of cardboard, to the back of the structure as in FIGS. 2–5. This permits optional addition of an easel 45 or a hanger 46. The reinforcement is not present in the alternatives of FIGS. 5A–5C. Near face 41 of the frame optionally may be adapted to engage and retain a transparent dust cover.

Figure 6:
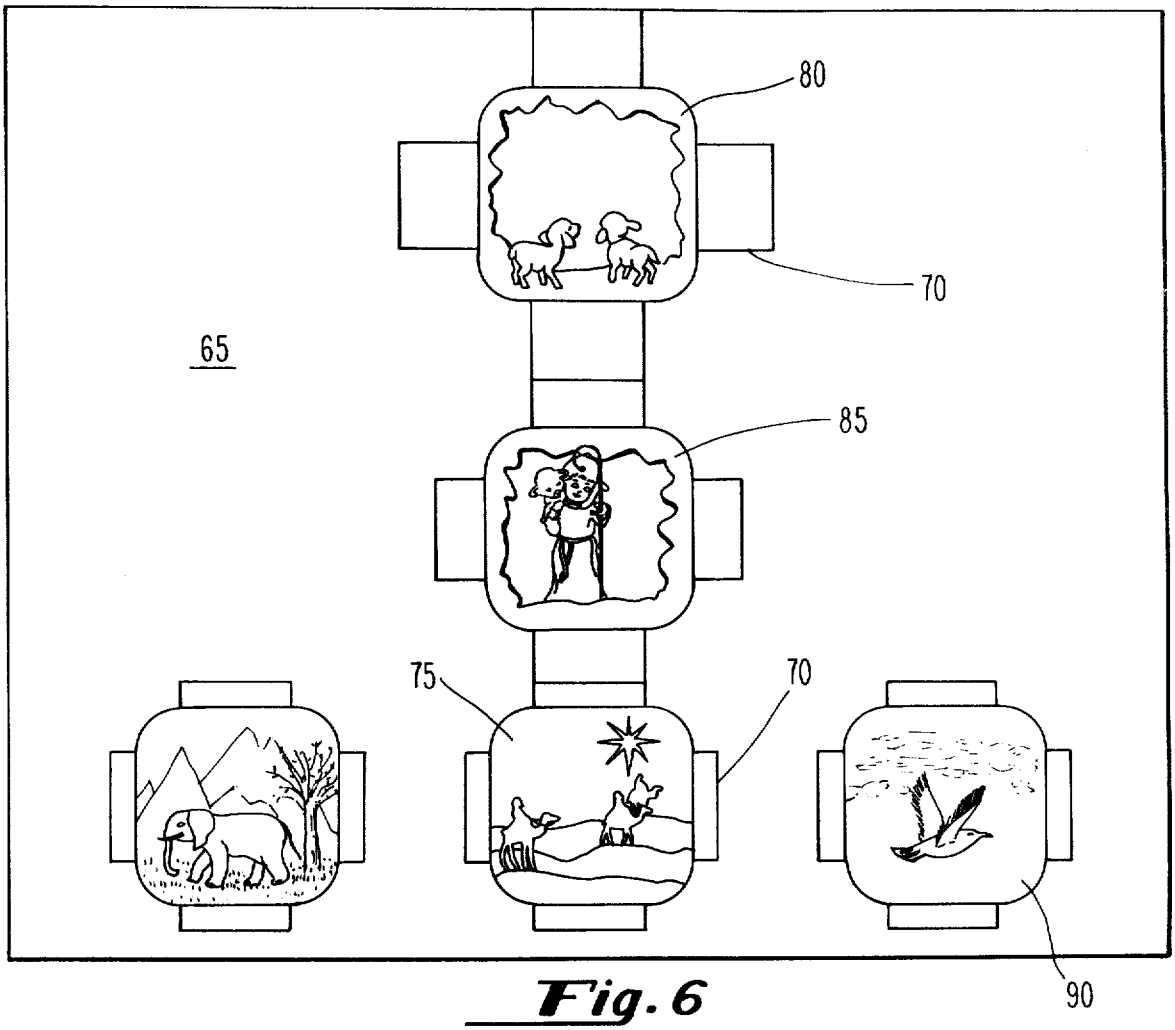
FIG. 6 is a plan view of the plurality of scenes found in a kit according to this invention.
Figure 7:
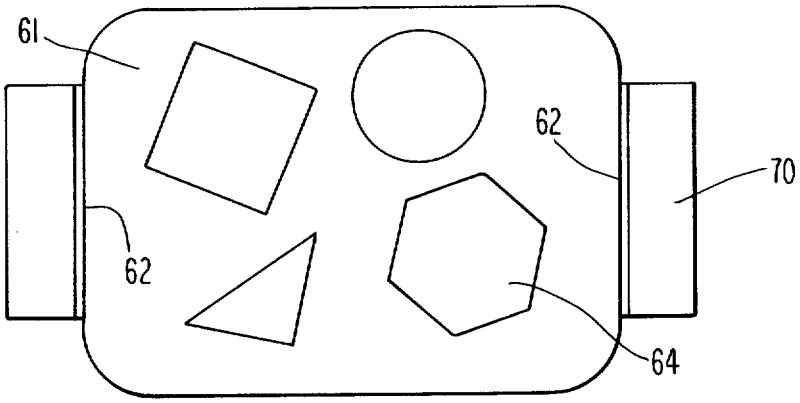
FIG. 7 is a plan view of a single scene employed in an embodiment of this invention.
Figure 8:
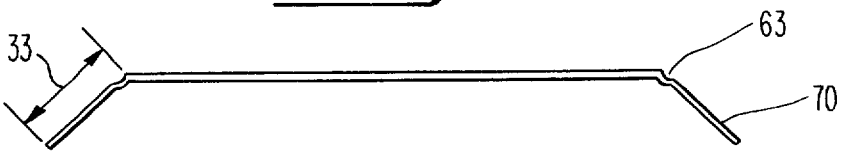
FIG. 8 is a side view of the scene shown in FIG. 7.

Another component of the kit is illustrated in FIGS. 6–8, namely, the plurality of scenes to be inserted into window 50 to make display 30. An individual scene, shown in FIGS. 7 and 8, is substantially planar and has a central adornable area 61 shaped to fit within window 50. The adornable area may have figures or designs thereon which are intended to be colored or otherwise completed, as by embroidery, cross-stitch, etc. In addition, adornable area 61 is generally adapted for cutout; e.g., region 64 is to be removed, revealing underlying scenes in the display. The scenes may be made of cardboard, plastic, or other suitable materials.

At least two scenes are necessary, but more scenes are advantageously provided. FIG. 6 shows one embodiment in which a set of three scenes, a remote scene 75, a nearest scene 80, and one other scene 85 are provided. Replica 90 of remote scene 75, but with different adornable area, is included; interchange then allows more than one picture to be created with the kit. If three versions of each of the three scenes were provided, 27 different pictures could be made with the kit. The individual scenes are conveniently mounted on carrier 65, from which they may be die-cut, or upon which they may be fastened.

In addition to an adornable area, each scene generally carries at least two, preferably four, flexible, bendably resilient hinges 70. These are illustrated in FIGS. 6–8 and extend beyond opposing straight edges 62 of adornable area 61. These hinges are adapted to bend backward approximately 90 degrees along the straight edges and mate with corresponding inner sides. Thus, the corresponding inner sides of the frame are also straight in the mating areas. In order to achieve the desired resiliency, a crease 63 may be embossed along the straight edge and the hinge adapted to bend backward at the crease as shown in FIG. 8.

The extension of the hinges in a given scene determines the depth 33 of that scene in window 50. The extension ranges between zero and the depth of the display; hinges may be omitted from the remote scene if desired, and the remote scene need not be adapted for cutout. In any case, referring now to FIG. 6, remote scene 75 is equipped with the shallowest hinges, the smallest adornable area, and is sized to stack behind all other scenes. Nearest scene 80 has the deepest hinges, the largest adornable area, is adapted for cutout, and is sized to stack in front of all other scenes. Any other scene, e.g., scene 85, is equipped with hinges of intermediate depth, intermediate adornable area, is adapted for cut out, and is sized to stack between remote scene 75 and nearest scene 80 in order according to hinge depth and size of adornable area.

In addition to the frame and plurality of scenes described above, the kit of this invention optionally may include materials, such as crayons, paints, thread, yarn, etc., with which to adorn the individual scenes. Using the components of the kit, the three-dimensional picture of this invention is created by removably inserting the scenes into window 50 in order, as shown in FIG. 1, the remote scene first, the nearest scene last, with hinges bent backward, butted against the backplate, and frictionally engaging other hinges, or the inner sides of the frame in the case of the nearest scene. An embodiment of a three-dimensional picture so created is illustrated in FIGS. 9 and 10.

Figure 9:
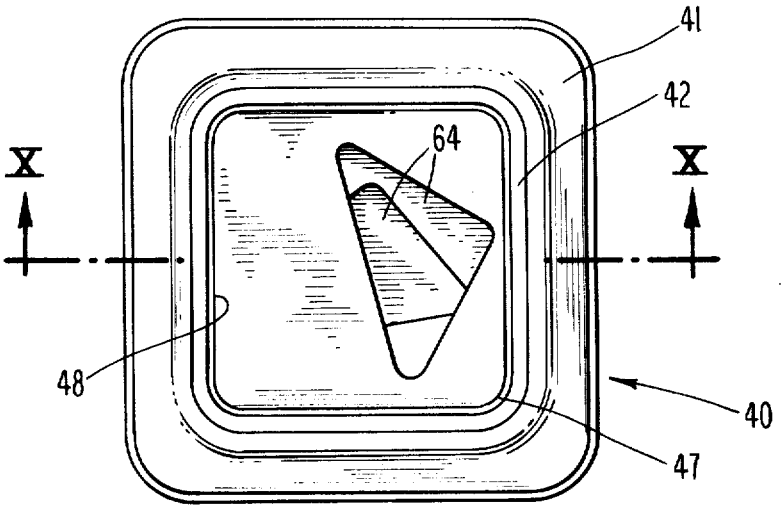
FIG. 9 is a front plan view illustrating another embodiment of the three-dimensional picture of this invention.
Figure 10:
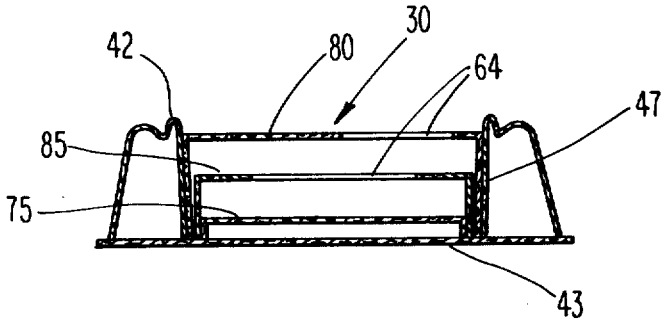
FIG. 10 is a cross-sectional view of the picture of FIG. 9 taken along X—X.
Figure 10A:
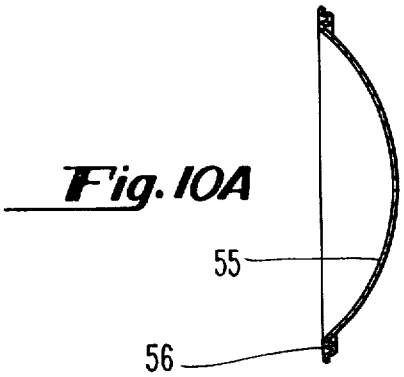
FIG. 10A is a similar cross-sectional view of a transparent dust cover which may be employed with the embodiment shown in FIGS. 9 and 10.

Referring now to FIGS. 9 and 10, frame 40 has inner sides 47 which, together with backplate 43, make an interior angle, the sides circumscribing a window which establishes the length and the breadth of display 30. Display 30 includes scenes 75, 80 and 85. Each scene has a central adornable area fitted within the window and at least two bendably resilient hinges bent backward up to the depth of the display along opposing straight edges of the adorned area. The hinges are mated with corresponding straight portions 48 of inner sides 47. The scenes are inserted removably into the window. Remote scene 75 has the shallowest hinges and the smallest adorned area; nearest scene 80 has the deepest hinges and the largest adorned area with a cut out region 64; the other scene 85 has hinges of intermediate length and intermediate adorned area with a cutout region 64. Near face 41 of frame 40 carries optional cover engagement 42. FIG. 10A illustrates optional transparent cover 55, which may be molded from flexible cellulose acetate or the like. The cover is equipped with U-shaped flange 56 to be frictionally and removable retained by cover engagement 42.

It will be evident a number of variations can be made while remaining within the scope of the following claims.

What is claimed is:

1. A kit for creating a three-dimensional picture comprising in combination a frame with inner sides which, together with a backplate, make an interior angle, said inner sides circumscribing a window which establishes a length and a breadth of a display;

a plurality of substantially planar scenes, each scene having a central adornable area shaped to fit within said window and at least two bendably resilient hinges extending between zero and the depth of the display beyond opposing straight edges of said adornable area and adapted to bend backward along said edges and mate with corresponding inner sides; said plurality including (a) a remote scene with the shallowest hinges, the smallest adornable area, and sized to stack behind all other scenes, (b) a nearest scene with the deepest hinges, the largest adornable area, adapted for cut out, and sized to stack in front of all other scenes, (c) any other scene having hinges of intermediate depth and intermediate adornable area, adapted for cut out, and sized to stack between said remote scene and said nearest scene in order according to hinge depth and size of adornable area;

whereby the three-dimensional picture is created by removably inserting said scenes into said window in order, the remote scene first, the nearest scene last, with hinges bent backward, butted against said backplate, and frictionally engaging other hinges or said inner sides, thereby setting the depths of the scenes and anchoring the scenes in said window.

2. The kit of claim 1 further comprising a transparent cover adapted to be engaged and retained at a near face of said frame.

3. The kit of claim 1 wherein said plurality of scenes includes a replica of one or more scenes, but with different adornable area, whereby more than one picture can be interchangeably created with said kit.

4. The kit of claim 1 wherein said interior angle is at least 90 degrees.

5. The kit of claim 4 wherein said interior angle is between 90 degrees and 95 degrees.

6. The kit of claim 1 wherein said hinges are adapted to bend backward at creases embossed along the edges of said adornable area.

7. The kit of claim 1 wherein said frame and said backplate are a unitary structure.

8. A three-dimensional picture comprising a frame with inner sides which, together with a backplate, make an interior angle, said inner sides circumscribing a window which establishes a length and a breadth of a display;

a plurality of substantially planar scenes, each scene having a central adorned area fitted within said window and at least two bendably resilient hinges bent backward between zero and the depth of the display along opposing straight edges of said adorned area, said edges mated with corresponding inner sides and said hinges butted against said backplate; said plurality including (a) a remote scene with the shallowest hinges, and the smallest adorned area inserted removably into said window behind all other scenes, (b) a nearest scene with the deepest hinges, and the largest adorned area, having a cut out region, and inserted removably into said window in front of all other scenes, (c) any other scene having hinges of intermediate depth and intermediate adorned area, having a cut out region, and inserted removably into said window between said remote scene and said nearest scene in order according to hinge depth and size of adorned area.

9. The picture of claim 8 further comprising a transparent cover adapted to be engaged and retained at a near face of said frame.

10. The picture of claim 8 wherein said interior angle is at least 90 degrees.

11. The picture of claim 10 wherein said interior angle is between 90 degrees and 95 degrees.

12. The picture of claim 8 wherein said hinges are bent backward at creases embossed along the edges of said adorned area.

13. The display of claim 8 wherein said frame and said backplate are a unitary structure.

* * * * *